US012370460B1

(12) United States Patent
Zhang

(10) Patent No.: US 12,370,460 B1
(45) Date of Patent: Jul. 29, 2025

(54) TOY CAR

(71) Applicant: Shenzhen Huamingjun Rubber Co., Ltd, Shenzhen (CN)

(72) Inventor: Hongjun Zhang, Shenzhen (CN)

( * ) Notice: Subject to any disclaimer, the term of this patent is extended or adjusted under 35 U.S.C. 154(b) by 0 days.

(21) Appl. No.: 18/964,731

(22) Filed: Dec. 2, 2024

(30) Foreign Application Priority Data

Jun. 12, 2024 (CN) ..... 202421337556.5

(51) Int. Cl.
*A63H 17/00* (2006.01)
*A63H 17/25* (2006.01)
*A63H 17/26* (2006.01)

(52) U.S. Cl.
CPC ..... *A63H 17/266* (2013.01); *A63H 17/004* (2013.01); *A63H 17/006* (2013.01); *A63H 17/25* (2013.01)

(58) Field of Classification Search
CPC .... A63H 17/00; A63H 17/004; A63H 17/006; A63H 17/02; A63H 17/262
See application file for complete search history.

(56) References Cited

U.S. PATENT DOCUMENTS 1,845,613 A * 2/1932 Marx ..... A63H 17/006 446/50
3,176,429 A * 4/1965 Brown ..... A63H 17/02 446/6
3,734,500 A * 5/1973 Cooper ..... A63H 17/02 446/6
4,295,292 A * 10/1981 Fitzgerald ..... A63F 9/14 446/6
4,693,693 A * 9/1987 Kennedy ..... A63H 17/02 446/6
4,744,781 A * 5/1988 Ostendorff ..... A63H 17/262 446/164
5,280,231 A * 1/1994 Kato ..... G01R 31/3648 320/155
5,752,871 A * 5/1998 Tsuzuki ..... A63H 17/004 446/457
5,762,533 A * 6/1998 Tilbor ..... A63H 17/262 446/469
6,857,930 B1 * 2/2005 Lawley, Jr. ..... A63H 17/10 206/427
10,232,277 B2 * 3/2019 Mueller ..... A63H 17/262
11,065,554 B2 * 7/2021 Cai ..... A63H 17/006

* cited by examiner

*Primary Examiner* — John A Ricci

(57) ABSTRACT

A toy car includes a body, an ejection mechanism, a collision mechanism, a first wheel assembly, and a driving mechanism. The body includes a placement position. The ejection mechanism may exert a force on the target object placed at the placement position to eject the target object from the placement position. The collision mechanism may exert a force on the ejection mechanism when triggered by an external force, causing the ejection mechanism to switch from the locked state to the unlocked state. The first wheel assembly includes a first wheel and a second wheel. The driving mechanism includes a first driving motor, a second driving motor, a first transmission structure, and a second transmission structure. The first driving motor may drive the first wheel through the first transmission structure, the second driving motor may drive the second wheel through the second transmission structure.

19 Claims, 9 Drawing Sheets

TOY CAR

CROSS-REFERENCE TO RELATED APPLICATIONS

The present disclosure claims priority of the Chinese Patent application No. 202421337556.5 entitled "TOY CAR" filed on Jun. 12, 2024, in the China National Intellectual Property Administration, the entire contents of which are incorporated herein by reference.

FIELD OF THE DISCLOSURE

The present disclosure relates to the technical field of children's toys, in particular to a toy car.

DESCRIPTION OF THE RELATED ART

Toys refer to items used for children's play and entertainment. There are various types of toys. Among them, toy cars are a highly interesting and common toy. For example, a toy car can be moved under the control of a user. Further, play battles can also be carried out by controlling the movement of toy cars.

However, current toy cars have a problem of a large turning radius during driving, resulting in poor driving flexibility, and thus reducing interest of users playing with toy cars.

SUMMARY OF THE DISCLOSURE

In a first aspect, one embodiment of the present disclosure provides a toy car, including:

a body, the body includes a placement position for placing a target object, the body includes a front end and a rear end which are opposite to each other;

an ejection mechanism, the ejection mechanism is arranged on the body and includes a locked state and an unlocked state; under a condition of switching from the locked state to the unlocked state, the ejection mechanism has relative displacement relative to the body, and exerts a force on the target object placed at the placement position to eject the target object from the placement position;

a collision mechanism, the collision mechanism is movably connected to the body and is configured to exert a force on the ejection mechanism when triggered by an external force, causing the ejection mechanism to switch from the locked state to the unlocked state;

a wheel assembly, the wheel assembly includes at least a first wheel assembly, the first wheel assembly includes a first wheel and a second wheel, the first wheel and the second wheel are respectively arranged on opposite sides of the body; and a driving mechanism, the driving mechanism includes a first driving motor, a second driving motor, a first transmission structure, and a second transmission structure;

wherein, the first driving motor is configured to connect with the first wheel and drive the first wheel through the first transmission structure, the second driving motor is configured to connect with the second wheel and drive the second wheel through the second transmission structure.

In a second aspect, one embodiment of the present disclosure provides a toy car, including:

a body, the body includes a placement position;

a target object, the target object is placed at the placement position;

an ejection mechanism, the ejection mechanism is arranged on the body and includes a locked state and an unlocked state; under a condition of switching from the locked state to the unlocked state, the ejection mechanism has relative displacement relative to the body, and exerts a force on a target object placed at the placement position to eject the target object from the placement position;

a collision mechanism, the collision mechanism is movably connected to the body and is configured to exert a force on the ejection mechanism when triggered by an external force, causing the ejection mechanism to switch from the locked state to the unlocked state;

a wheel assembly, the wheel assembly includes at least a first wheel assembly, the first wheel assembly includes a first wheel and a second wheel; the first wheel and the second wheel are respectively arranged on opposite sides of the front end of the body; or, the first wheel and the second wheel are respectively arranged on opposite sides of the rear end of the body; and a driving mechanism, the driving mechanism includes a first driving motor, a second driving motor, a first transmission structure, and a second transmission structure;

wherein, the first driving motor is configured to connect with the first wheel and drive the first wheel through the first transmission structure, the second driving motor is configured to connect with the second wheel and drive the second wheel through the second transmission structure, and both the first driving motor and the second driving motor are driven independently.

BRIEF DESCRIPTION OF THE DRAWINGS

In order to more clearly illustrate the technical solutions of the embodiments of the present disclosure, the following will briefly introduce the accompanying drawings that need to be used in the description of the embodiments. It is obvious that the accompanying drawings in the following description are some of the embodiments of the present disclosure, and for those having ordinary skill in the art, without the exertion of creative labor, other accompanying drawings can be obtained based on these drawings.

Figure 1:
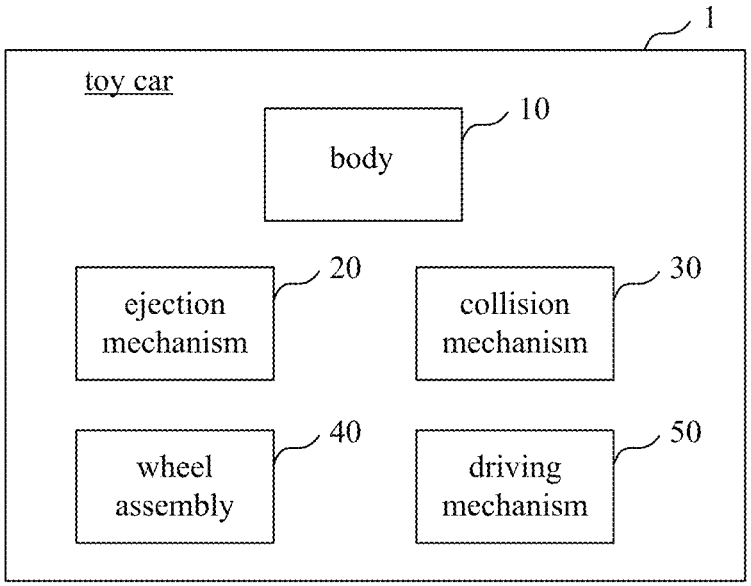
FIG. 1 is a modular structure diagram of a toy car according to one embodiment of the present disclosure.
Figure 2:
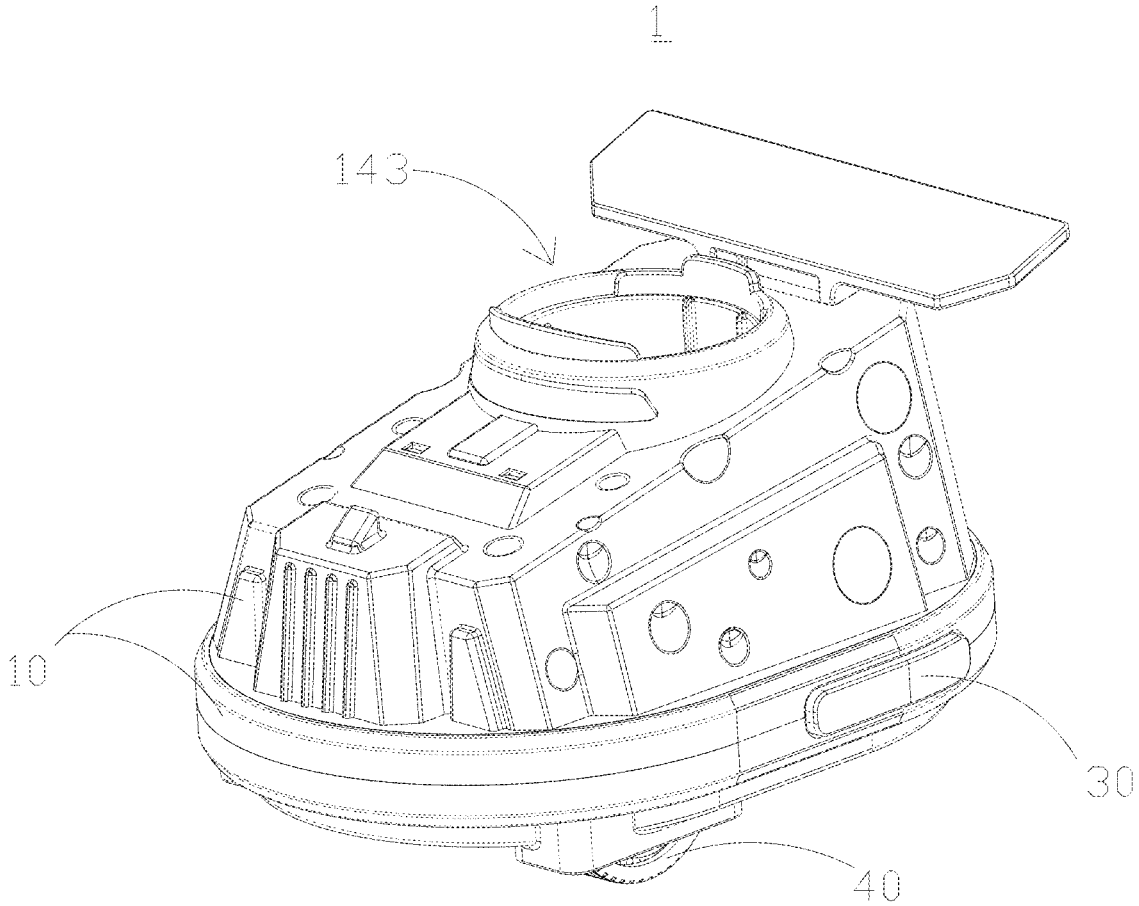
FIG. 2 is a schematic structural diagram of a toy car according to one embodiment of the present disclosure.
Figure 3:
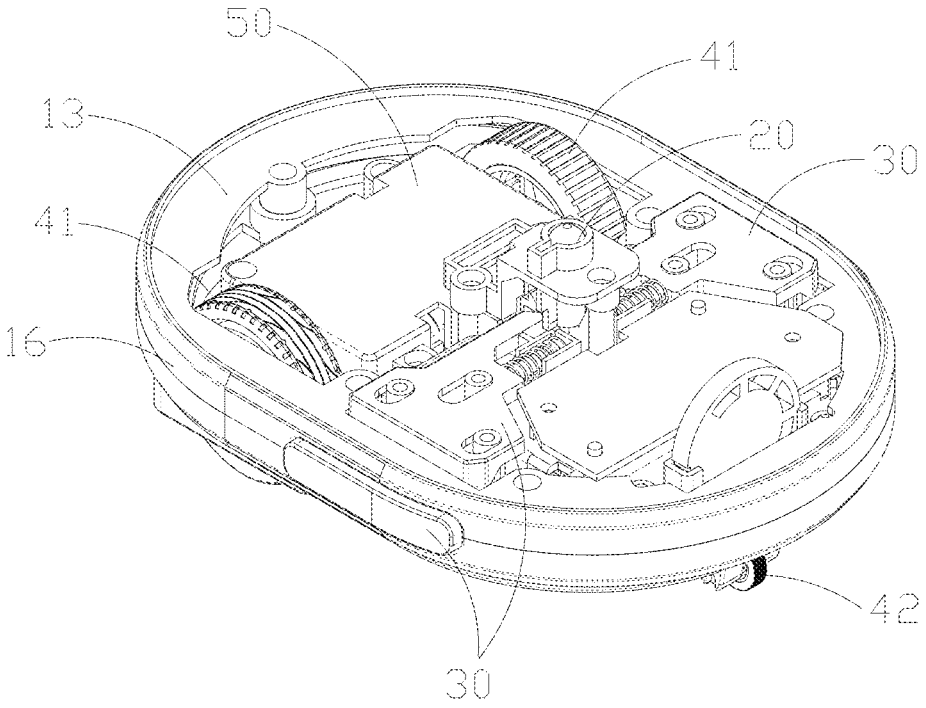
FIG. 3 is an internal structure diagram of a toy car provided according to one embodiment of the present disclosure.

List of reference signs in embodiments of the present disclosure:

1, toy car; 10, body; 11, front end; 12, rear end; 13, chassis; 14, housing; 141, object mounting portion; 142, object mounting groove; 143, placement position; 144, mounting-guiding structure; 150, receiving cavity; 15, opening; 16, protective frame; 17, first guide post; 20, ejection mechanism; 21, force-exerting member; 211, first chamber; 212, second guiding portion; 213, snap-fit portion; 214, limiting post; 215, first wedge-shaped surface; 22, locking member; 221, second wedge-shaped surface; 222, fourth wedge-shaped surface; 23, first elastic member; 24, limiting member; 25, second elastic member; 241, first guiding portion; 30, collision mechanism; 31, collision member; 311, transmission portion; 312, collision portion; 313, guiding groove; 314, third wedge-shaped surface; 32, a third elastic member; 40, wheel assembly; 41, first wheel assembly; 411, first wheel; 412, second wheel; 42, second wheel assembly; 50, driving mechanism; 501, driving mounting member; 51, first driving motor; 52, second driving motor; 53, first transmission structure; 531, first gear assembly; 54, second transmission structure; 541, second gear assembly; 55, mounting chamber; 56, connection portion; 60, target object.

DETAILED DESCRIPTION

A description of the technical solutions provided in embodiments of the present disclosure is provided below with reference to drawings of the embodiments of the present disclosure. It is evident that the described embodiments are some of the embodiments of the present disclosure, and are not all embodiments of the present disclosure. Based on the embodiments of the present disclosure, other embodiments obtained by those having ordinary skill in the art without making creative labor are also within the scope of protection of the present disclosure.

The flowcharts shown in the drawings are merely illustrative and are not required to include all the contents and operations/steps, nor are they required to be executed in the described order. For example, some operations/steps may also be decomposed, combined, or partially merged, so the actual execution order may change according to the actual situation. The above description is only a specific embodiment of the present disclosure, but the scope of protection of the present disclosure is not limited to these. Any technician familiar with the technical field can easily think of various equivalent modifications or substitutions within the technical scope disclosed by the present disclosure, and these modifications or substitutions should be covered within the scope of protection of the present disclosure. Therefore, the scope of protection of the present disclosure should be subject to the scope of protection of the claims. For example, some operations/steps may also be decomposed, combined or partially merged, and thus the actual order of execution may change according to the actual situation. The above description is only a specific embodiment of the present disclosure, but the scope of protection of the present disclosure is not limited thereto, and any person skilled in the art can readily think of various equivalent modifications or substitutions within the scope of the technology disclosed in the present disclosure, which shall be covered by the scope of protection of the present disclosure. Therefore, the scope of protection of the present disclosure shall be subject to the scope of protection of the claims.

In the following, a detailed description of some embodiments of the present disclosure is provided in conjunction with the drawings. Unless conflicting, following embodiments and features in the embodiments may be combined with each other.

Embodiments of the present disclosure provide a toy car, intended to reduce a turning radius of a toy car when driving, to enhance driving flexibility of the toy car, especially steering flexibility.

As shown in FIG. 1 to FIG. 4, an embodiment of the present disclosure provides a toy car 1 for performing driving actions for play. The toy car 1 includes a body 10, an ejection mechanism 20, a collision mechanism 30, a wheel assembly 40, and a driving mechanism 50. Specific structures of components of the toy car 1 and the cooperation between them will be specifically described below.

Specifically, the body 10 includes a front end 11 and a rear end 12 which are opposite to each other, and the body 10 includes a placement position 143, the placement position 143 may be configured to place a target object 60. The ejection mechanism 20 is arranged on the body 10 and includes a locked state and an unlocked state. The ejection mechanism 20 may switch between the locked state and the unlocked state. Under a condition of switching from the locked state to the unlocked state, the ejection mechanism 20 may have relative displacement relative to the body 10, and exert a force on a target object 60 placed at the placement position 143 to eject the target object 60 from the placement position 143. The collision mechanism 30 is movably connected to the body 10 and is configured to exert a force on the ejection mechanism 20 when triggered by an external force, causing the ejection mechanism 20 to switch from the locked state to the unlocked state, so that the ejection mechanism 20 may have relative displacement relative to the body 10, and exert a force on the target object 60 placed at the placement position 143 to eject the target object 60 from the placement position 143.

Exemplarily, at least part of the collision mechanism 30 is exposed outside the body 10. When an external force collides with the exposed part of the collision mechanism 30, the collision mechanism 30 is triggered by the external force and exerts a force on the ejection mechanism 20, causing the ejection mechanism 20 to switch from the locked state to the unlocked state.

Specifically, the wheel assembly 40 includes at least a first wheel assembly 41. The first wheel assembly 41 includes a first wheel 411 and a second wheel 412, and the first wheel 411 and the second wheel 412 are respectively arranged on opposite sides of the body 10. The driving mechanism 50 includes a first driving motor 51, a second driving motor 52, a first transmission structure 53, and a second transmission structure 54. Wherein, the first driving motor 51 is configured to connect with the first wheel 411 and drive the first wheel 411 through the first transmission structure 53, the second driving motor 52 is configured to connect with the second wheel 412 and drive the second wheel 412 through the second transmission structure 54, and both the first driving motor 51 and the second driving motor 52 may be driven independently.

Exemplarily, the front end 11 of the body 10 corresponds to a forward direction of the toy car 1, the rear end 12 of the body 10 corresponds to a backward direction of the toy car 1.

Specifically, the first wheel 411 and the second wheel 412 are respectively arranged on opposite sides of the front end 11 of the body 10, or on opposite sides of the rear end 12 of the body 10. It should be understood that the first driving motor 51 and the second driving motor 52 may drive the first wheel 411 and the second wheel 412 respectively, enabling the toy car 1 to achieve driving movement, and the first driving motor 51 and the second driving motor 52 can drive the first wheel 411 and the second wheel 412 to rotate at different speeds, resulting in achieving steering and turning during the driving movement.

Since the first driving motor 51 and the second driving motor 52 can be driven independently, a rotational speed difference between the first wheel 411 and the second wheel 412 can be flexibly adjusted to reduce a turning radius of the toy car 1, resulting in enhancing driving flexibility of the toy car 1, especially steering flexibility, and further enhancing interest of users playing with the toy car 1.

Figure 4:
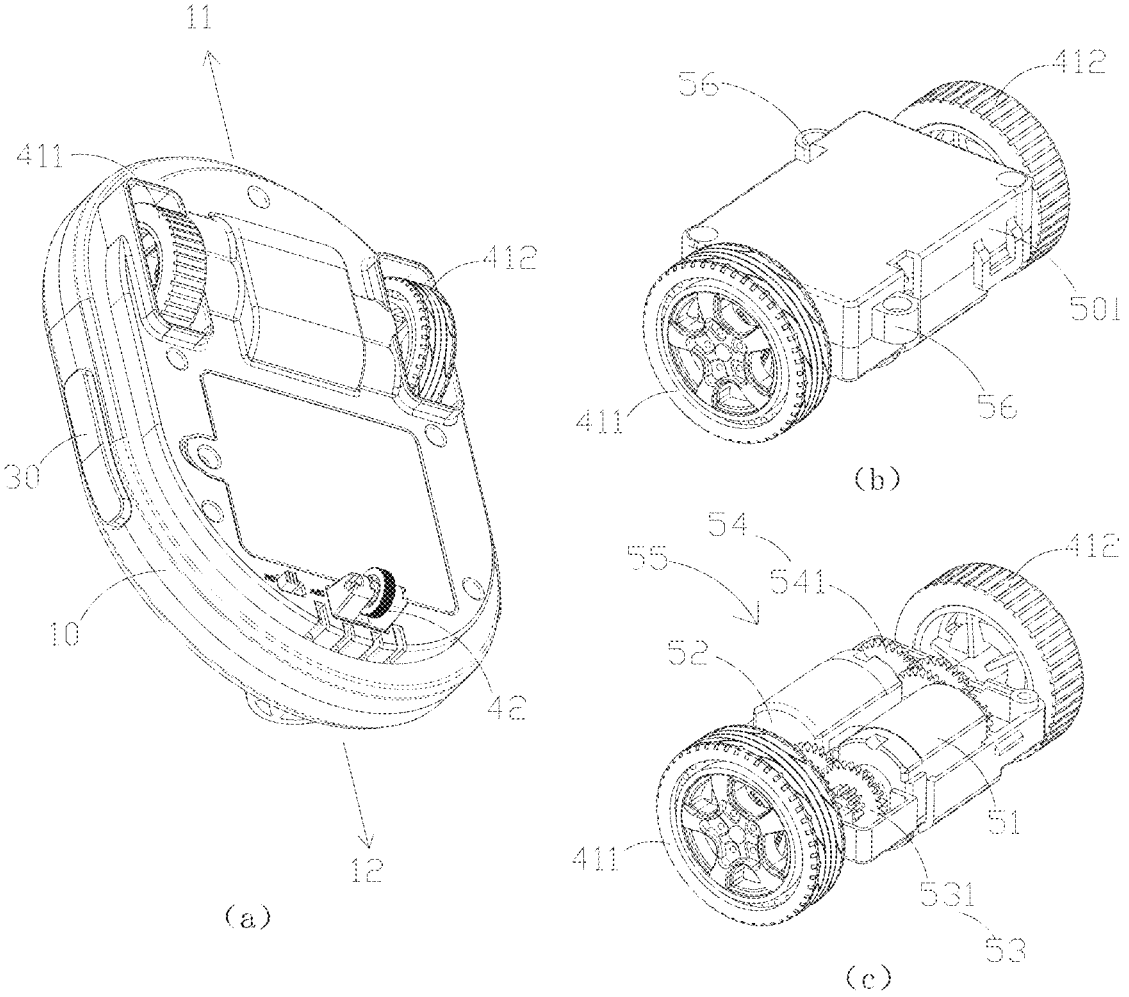
FIG. 4 is a schematic structure diagram of a wheel assembly and a driving mechanism of a toy car according to one embodiment of the present disclosure.
Figure 5:
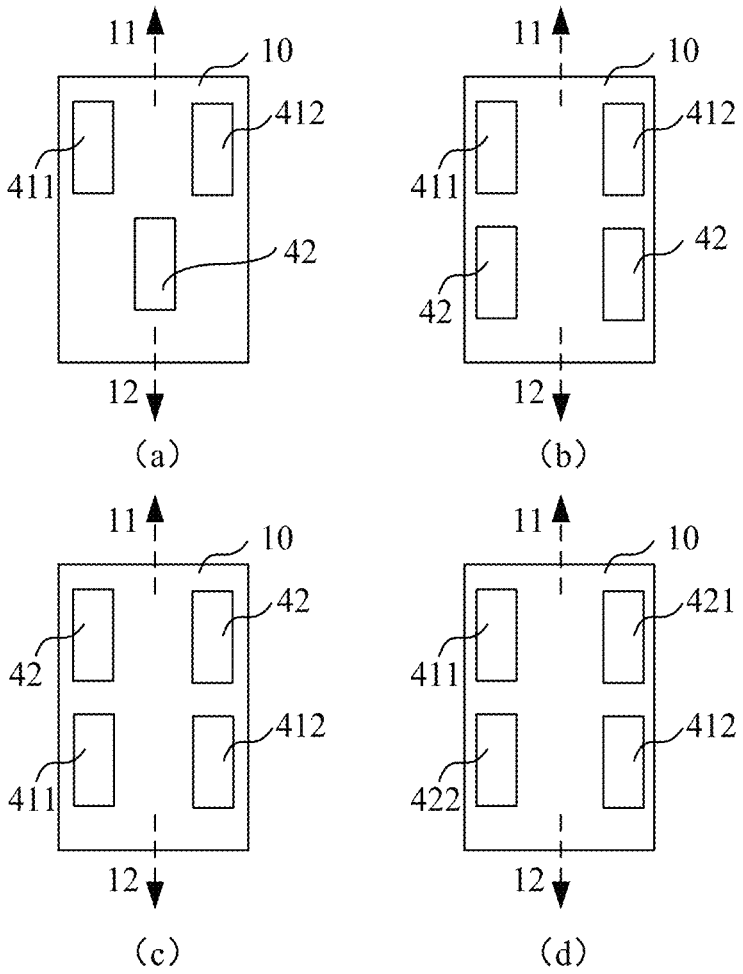
FIG. 5 is a schematic diagram of various arrangements of a wheel assembly of a toy car according to one embodiment of the present disclosure.

As shown in FIG. 4, FIG. 5(*a*), and FIG. 5(*b*), in some embodiments, the first wheel 411 and the second wheel 412 are arranged on opposite sides of the front end 11 of the body 10. For example, the first wheel 411 is arranged on a left side of the front end 11 of the body 10, and the second wheel 412 is arranged on a right side of the front end 11 of the body 10.

As shown in FIG. 5(*c*), in other embodiments, the first wheel 411 and the second wheel 412 are arranged on opposite sides of the rear end 12 of the body 10. For example, the first wheel 411 is arranged on a left side of the rear end 12 of the body 10 and the second wheel 412 is arranged on a right side of the rear end 12 of the body 10.

It should be understood that the first wheel 411 and the second wheel 412 are arranged on opposite sides of the front end 11 or the rear end 12 of the body 10, the first wheel 411 and the second wheel 412 can be driven to rotate at different speeds, so as to achieve steering and turning. Moreover, since the first driving motor 51 and the second driving motor 52 can be driven independently, a rotational speed difference between the first wheel 411 and the second wheel 412 can be flexibly adjusted to reduce a turning radius of the toy car 1, resulting in enhancing driving flexibility of the toy car 1, especially steering flexibility, and further enhancing interest of users playing with the toy car 1.

As shown in FIG. 5(*d*), in some embodiments, the first wheel assembly 41 includes a first wheel 411 and a second wheel 412, the second wheel assembly 42 includes a third wheel and a fourth wheel. The first wheel 411 is arranged on a first side of the front end 11 of the body 10, the third wheel is arranged on a second side of the front end 11 of the body 10, the fourth wheel is arranged on a first side of the rear end 12 of the body 10, the second wheel 412 is arranged on a second side of the rear end 12 of the body 10, and the second side is opposite to the first side.

Exemplarily, the first wheel 411 is arranged on a left side of the front end 11 of the body 10, the third wheel is arranged on a rear side of the front end 11 of the body 10, the fourth wheel is arranged on a left side of the rear end 12 of the body 10, and the second wheel 412 is arranged on a right side of the rear end 12 of the body 10.

It should be understood that the first wheel 411 and the second wheel 412 are arranged on opposite sides of the body 10, and since the first driving motor 51 is connected to the first wheel 411 and drives the first wheel 411 through the first transmission structure 53, and the second driving motor 52 is connected to the second wheel 412 and drives the second wheel 412 through the second transmission structure 54, the toy car 1 in the present embodiment can also achieve steering and turning by driving the first wheel 411 and the second wheel 412 to rotate at different speeds.

As shown in FIG. 1 to FIG. 5, in some embodiments, the wheel assembly 40 further includes a second wheel assembly 42, the first wheel assembly 41 and the second wheel assembly 42 both are arranged on the body 10, and the first wheel assembly 41 cooperates with the second wheel assembly 42 to maintain the balance of the body 10. For example, the second wheel assembly 42 is a driven wheel.

Specifically, the second wheel assembly 42 includes one, two, or more wheels. For example, the second wheel assembly 42 in FIG. 5(*a*) includes one wheel, the second wheel assembly 42 in FIG. 5(*b*) includes two wheels.

The first transmission structure 53 and the second transmission structure 54 are specifically described. For example, the first transmission structure 53 includes, but is not limited to, at least one of a gear assembly, a belt and a chain. The second transmission structure 54 includes, but is not limited to, at least one of a gear assembly, a belt and a chain.

As shown in FIG. 4, in some embodiments, the first transmission structure 53 includes a first gear assembly 531, and the first gear assembly 531 is connected between an output end of the first driving motor 51 and the first wheel 411, the first driving motor 51 may drive the first wheel 411 to rotate through the first gear assembly 531.

In some embodiments, the second transmission structure 54 includes a second gear assembly 541, and the second gear assembly 541 is connected between an output end of the second driving motor 52 and the second wheel 412, and the second driving motor 52 may drive the second wheel 412 to rotate through the second gear assembly 541.

As shown in FIG. 1 to FIG. 5, in some embodiments, the driving mechanism 50 further includes a driving mounting member 501 with a mounting chamber 55. The first driving motor 51, the second driving motor 52, the first transmission structure 53, and the second transmission structure 54 are all accommodated in the mounting chamber 55, and at least two connecting portions 56 are arranged on a peripheral side of the driving mounting member 501. The driving mounting member 501 is detachably connected to the body 10 through the connecting portion 56.

Exemplarily, the first transmission structure 53 includes a first gear assembly 531, the second transmission structure 54 includes a second gear assembly 541. The first driving motor 51, the second driving motor 52, the first transmission structure 53, and the second transmission structure 54 are all accommodated in the mounting chamber 55.

It should be noted that when the detachable connection between the driving mounting member 501 and the body 10 is disengaged, the driving mounting member 501 with the first driving motor 51, the second driving motor 52, the first transmission structure 53 and the second transmission structure 54 accommodated in the mounting chamber 55 can be detached from the body 10. This modular design facilitates production, assembly, and replacement of certain structures of the toy car 1 during maintenance, and the driving mounting member 501 can effectively protect components accommodated in the mounting chamber 55.

As shown in FIG. 1 to FIG. 9, in some embodiments, the ejection mechanism 20 includes at least a force-exerting member 21, a locking member 22 which can be engaged in a locking engagement with the force-exerting member 21, and a first elastic member 23 for providing an elastic force to the force-exerting member 21. The force-exerting member 21 may be displaced relative to the body 10 during elastic deformation process of the first elastic member 23.

When the ejection mechanism 20 is in the locked state, the locking member 22 is engaged in a locking engagement with the force-exerting member 21, and the first elastic member 23 is deformed to store energy through the force-exerting member 21.

When the locking engagement of the locking member 22 and the force-exerting member 21 is released, the force-exerting member 21 moves toward a side closer to the placement position 143 relative to the body 10 under an elastic force of the first elastic member 23, so as to exert a force on the target object 60 placed at the placement position 143.

Figure 6:
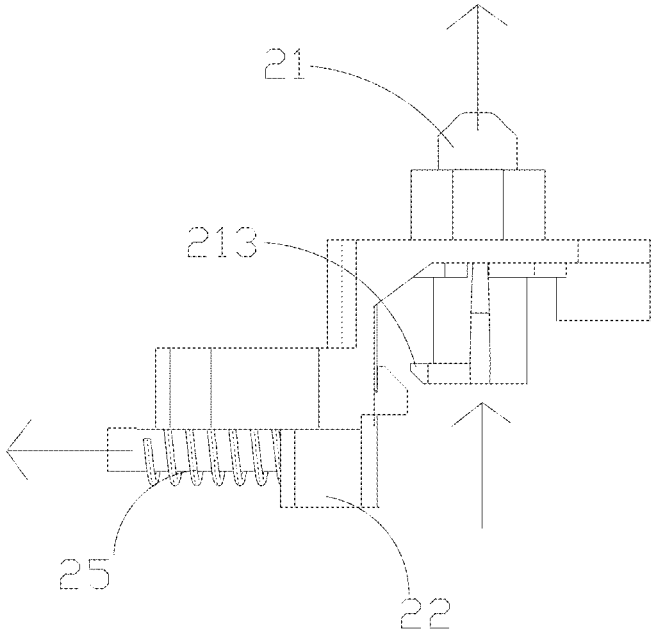
FIG. 6 is a schematic diagram of an ejection mechanism of a toy car moving toward a placement position to eject a target object according to one embodiment of the present disclosure.
Figure 8:
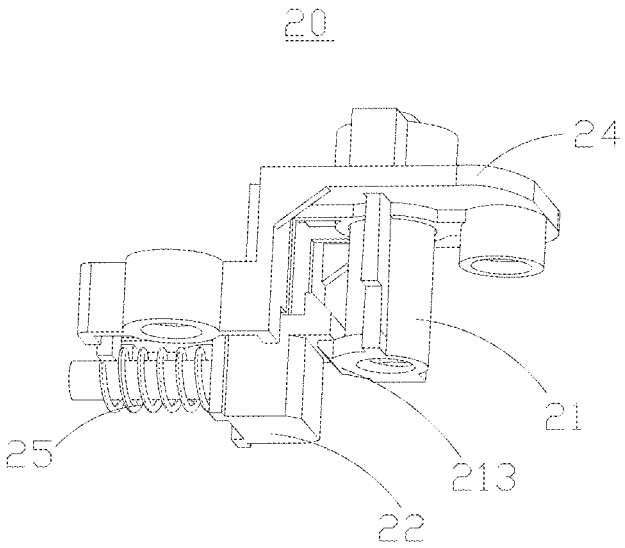
FIG. 8 is a schematic diagram of an ejector mechanism in a locked state according to one embodiment of the present disclosure.
Figure 9:
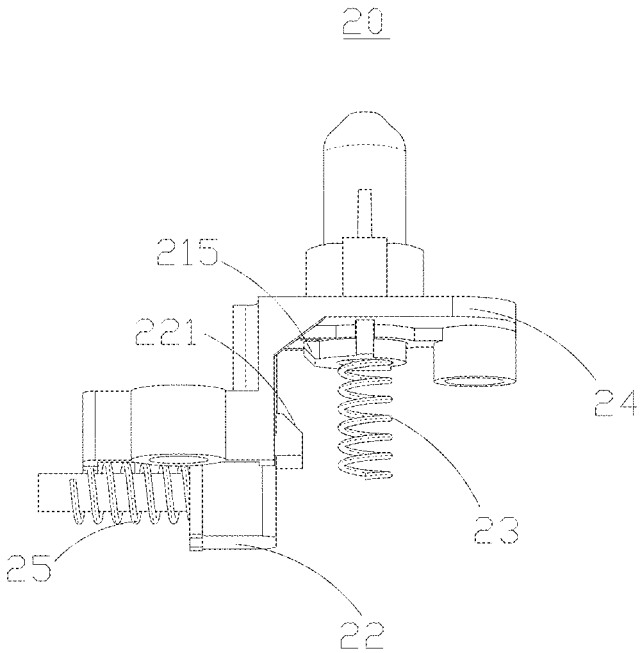
FIG. 9 is a schematic diagram of an ejector mechanism in an unlocked state according to one embodiment of the present disclosure.

Specifically, as shown in FIG. 8, when the ejection mechanism 20 is in the locked state, the locking member 22 is engaged in a locking engagement with the force-exerting member 21, and the first elastic member 23 is deformed to store energy through the force-exerting member 21. As shown in FIG. 6 and FIG. 9, when the collision mechanism 30 is triggered by an external force to exert a force on the ejection mechanism 20, the ejection mechanism 20 is switched from the locked state to the unlocked state. When the locking engagement of the locking member 22 and the force-exerting member 21 is released, the force-exerting member 21 moves toward a side closer to the placement position 143 relative to the body 10 under an elastic force of the first elastic member 23, so as to exert a force on the target object 60 placed at the placement position 143.

Through the cooperation of the force-exerting member 21, the locking member 22, and the first elastic member 23, when the collision mechanism 30 is triggered by an external force, the ejection mechanism 20 can be quickly and reliably switched to the unlocked state and exert a force on the target object 60 placed at the placement position 143, in order to eject the target object 60 from the placement position 143.

As shown in FIG. 1 to FIG. 9, in some embodiments, the force-exerting member 21 is configured with a first chamber 211 for accommodating the first elastic member 23, the body 10 is configured with a first guide post 17, and the first elastic member 23 is mounted around the first guide post 17 and is in contact between the force-exerting member 21 and the body 10.

Specifically, at least a portion of the first guide post 17 is accommodated in the first chamber 211, the first elastic member 23 is mounted around the first guide post 17. The first guide post 17 is configured to restrict a direction of the elastic deformation of the first elastic member 23, so as to guide a force-exerting direction of the first elastic member 23 during elastic reset, and thus to ensure that the force-exerting direction of the first elastic member 23 is accurate and centralized, and the target object 60 placed at the placement position 143 can be reliably ejected through the force-exerting member 21.

Exemplarily, an extension direction of the first guide post 17 is a direction of the placement position 143 relative to the force-exerting member 21, a guidance direction of the first guide post 17 is also the direction of the placement position 143 relative to the force-exerting member 21.

Exemplarily, the first elastic member 23 includes a spring, one end of the spring is in contact with the body 10, the other end of the spring is in contact with the force-exerting member 21 and mounted around the first guide post 17. When the locking member 22 is engaged in a locking engagement with the force-exerting member 21, the first elastic member 23 is elastically compressed under the pressure of the force-exerting member 21 and the body 10. When the locking engagement of the locking member 22 of the ejection mechanism 20 and the force-exerting member 21 is released, the first elastic member 23 elastically resets and exerts a force on the force-exerting member 21, so as to eject the force-exerting member 21 relative to the body 10.

In some embodiments, the ejection mechanism 20 further includes a limiting member 24, the limiting member 24 is connected to the body 10 and is configured to limit a moving distance of the force-exerting member 21 relative to the body 10 in an ejection direction.

Specifically, when the locking engagement of the locking member 22 of the ejection mechanism 20 and the force-exerting member 21 is released, the force-exerting member 21 moves toward a side closer to the placement position 143 relative to the body 10 under an elastic force of the first elastic member 23, and during the process of the force-exerting member 21 moving toward the side closer to the placement position 143, the limiting member 24 is snap-fitted with the force-exerting member 21 to limit the movement distance of the force-exerting member 21 relative to the body 10 in the ejection direction, preventing the force-exerting member 21 from being ejected from the body 10, facilitating repeated play with the toy car 1.

As shown in FIG. 1 to FIG. 9, in some embodiments, the limiting member 24 is detachably connected to the body 10, and an inner side of the limiting member 24 is provided with a first guiding portion 241, and a peripheral side of the force-exerting member 21 is further provided with a second guiding portion 212 adapted to the first guiding portion 241.

Wherein, the second guiding portion 212 includes one, two, or more.

Exemplarily, the first guiding portion 241 is configured as a groove, and the second guiding portion 212 is configured as a protrusion adapted to the first guiding portion 241; or, the first guiding portion 241 is configured as a protrusion, and the second guiding portion 212 is configured as a groove adapted to the first guiding portion 241.

Specifically, the first guiding portion 241 and the second guiding portion 212 cooperate to guide the movement direction of the force-exerting member 21, and the guidance direction is a direction of the placement position 143 relative to the force-exerting member 21, ensuring that a force-exerting direction of the force-exerting member 21 to the target object 60 placed at the placement position 143 is accurate and concentrated, and that the target object 60 can be more reliably ejected.

In some embodiments, the second guiding portion 212 includes at least two, and the at least two second guiding portions 212 are spaced apart on a peripheral side of the force-exerting member 21, so that guiding effect of the first guiding portion 241 and the second guiding portion 212 on the movement direction of the force-exerting member 21 is uniformly exerted on the peripheral side of the force-exerting member 21, enhancing accuracy of guidance.

In some embodiments, under force-exerting trigger of the collision mechanism 30, the locking member 22 may be displaced relative to the body 10. The ejection mechanism 20 further includes a second elastic member 25 arranged between the locking member 22 and the body 10, the second elastic member 25 is configured to provide an elastic force to the locking member 22.

Wherein, when the locking member 22 is triggered by the collision mechanism 30, the locking member 22 moves toward a side away from the force-exerting member 21 to release the locking engagement of the locking member 22 and the force-exerting member 21, and cause the second elastic member 25 to deform and store energy.

When the collision mechanism 30 releases the force exerted on the locking member 22, the second elastic member 25 releases elastic energy storage and drives the locking member 22 to move toward a side closer to the force-exerting member 21.

Specifically, the locking member 22 is triggered by the collision mechanism 30 to move toward a side away from the force-exerting member 21 to release the locking engagement of the locking member 22 and the force-exerting member 21, and causes the second elastic member 25 to deform and store energy. When the locking engagement of the locking member 22 and the force-exerting member 21 is released, the force-exerting member 21 moves toward a side closer to the placement position 143 relative to the body 10 by an elastic force of the first elastic member 23, so as to eject the target object 60 placed at the placement position 143. Moreover, after the force-exerting member 21 moves toward a side closer to the placement position 143 relative to the body 10, when the collision mechanism 30 releases the force exerted on the locking member 22, the second elastic member 25 releases elastic energy storage and drives the locking member 22 to move toward a side closer to the force-exerting member 21, achieving the reset of the locking member 22.

Thus, when the collision mechanism 30 is triggered by an external force, the locking member 22 can quickly and reliably release the locking engagement with the force-exerting member 21 under the trigger of the collision mechanism 30, allowing the force-exerting member 21 to eject the target object 60 from the placement position 143 under the action of the first elastic member 23.

Figure 10:
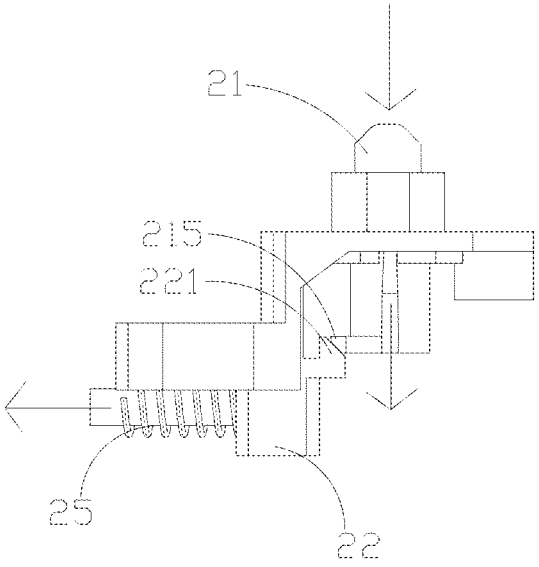
FIG. 10 is a schematic diagram of a force-exerting member being reset by an external force according to one embodiment of the present disclosure.

As shown in FIG. 10, in some embodiments, the force-exerting member 21 may move toward a side closer to the body 10 by an external force, and exerts a force on the locking member 22 to move the locking member 22 away from the force-exerting member 21. During the process of the locking member 22 moving away from the force-exerting member 21, the locking member 22 compresses the second elastic member 25, causing the second elastic member 25 to deform and store energy.

When the force-exerting member 21 moves toward a side closer to the body 10 to a predetermined position, the second elastic member 25 releases the elastic energy storage and drives the locking member 22 to move toward a side closer to the force-exerting member 21, so that the locking member 22 is engaged in a locking engagement with the force-exerting member 21, causing the ejection mechanism 20 to be in a locked state.

It should be noted that the above external force may be a force exerted by a user toward the body 10 on the force-exerting member 21, or a force exerted by a user through the target object 60 toward the body 10 on the force-exerting member 21. The cooperation of components of the ejection mechanism 20 and the body 10 enables the locking member 22 to engage in a locking engagement with the force-exerting member 21.

Specifically, when the force-exerting member 21 moves relative to the body 10 toward a side closer to the placement position 143 under an elastic force of the first elastic member 23 and reaches a predetermined position, the second elastic member 25 releases elastic storage energy to drive the locking member 22 to move toward a side closer to the force-exerting member 21, achieving the reset of the locking member 22. the reset locking member 22 is engaged in a locking engagement with the force-exerting member 21, resulting in limiting the force-exerting member 21 to the predetermined position.

Thus, the force-exerting member 21 may be pressed in a direction toward the body 10 to move the force-exerting member 21 to the predetermined position, or the target object 60 may be pressed to the placement position 143 to exert a force on the force-exerting member 21 in a direction toward the body 10 through the target object 60 to move the force-exerting member 21 to the predetermined position, so that the force-exerting member 21 is engaged in a locking engagement with the locking member 22.

Furthermore, under the condition of the ejection mechanism 20 switching from a locked state to an unlocked state, the ejection mechanism 20 may be displaced relative to the body 10 again to eject the target object 60 from the placement position 143, so as to achieve the effect of repeated play and enhance the play experience of the toy car 1.

As shown in FIG. 6 to FIG. 10, in some embodiments, the force-exerting member 21 is configured with a snap-fit portion 213, and the locking member 22 may be snap-fitted with the force-exerting member 21 through the snap-fit portion 213, so that the force-exerting member 21 is engaged in a locking engagement with the locking member 22.

Wherein, the snap-in portion 213 includes a first wedge-shaped surface 215 on a side closer to the body 10, and the locking member 22 includes a second wedge-shaped surface 221 on a side away from the body 10, the second wedge-shaped surface 221 may be adapted to the first wedge-shaped surface 215.

Specifically, during the process of locking the force-exerting member 21 with the locking member 22, the force-exerting member 21 moves toward a side closer to the body 10 under the action of an external force, and the first wedge-shaped surface 215 of the snap-in portion 213 is in transmission engagement with the second wedge-shaped surface 221 of the locking member 22, causing the locking member 22 to move away from the collision mechanism 30, so as to reduce a resistance of the force-exerting member 21 to move toward a side closer to the body 10, and to facilitate the locking engagement of the force-exerting member 21 and the locking member 22, further achieving the effect of repeated play and enhancing the play experience of the toy car 1.

Furthermore, after locking the force-exerting member 21 with the locking member 22, the locking member 22 may be snap-fitted with the force-exerting member 21 through the snap-fit portion 213 to limit the force-exerting member 21 to the predetermined position.

Figure 11:
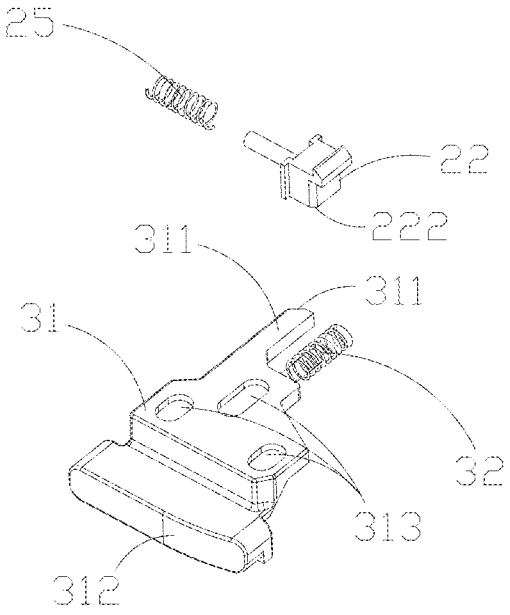
FIG. 11 is a schematic structural diagram of a collision mechanism according to one embodiment of the present disclosure.

As shown in FIG. 11, in some embodiments, the collision mechanism 30 includes at least a collision member 31 and a third elastic member 32 for providing an elastic force to the collision member 31. During elastic deformation process of the third elastic member 32, the collision member 31 may be displaced relative to the body 10.

Wherein, the collision member 31 includes a transmission portion 311 arranged on a side closer to the locking member 22 and a collision portion 312 arranged on a side away from the locking member 22, and at least a part of the collision portion 312 is exposed outside the body 10.

When the collision portion 312 is subjected to an external force in a first direction, the collision member 31 moves toward the locking member 22 relative to the body 10 and exerts a force on the locking member 22 through the transmission portion 311 to release the locking engagement of the locking member 22 and the force-exerting member 21. During a movement process of the collision member 31 in the first direction, the third elastic member 32 deforms and stores energy, and the first direction is a direction of the transmission portion 311 relative to the collision portion 312.

When the external force on the collision portion 312 in the first direction is released, the collision member 31 moves relative to the body 10 toward a side away from the locking member 22 by an elastic force of the third elastic member 32 to reset.

It should be noted that at least a part of the collision portion 312 is exposed outside the body 10. During play with toy car 1, when an exposed side of the collision portion 312 is subjected to a collision from outside of the toy car 1, the collision portion 312 exposed to the body 10 is subjected to an external force, causing the collision member 31 to move relative to the body 10 toward the locking member 22, and exerting a force on the locking member 22 through the transmission portion 311 to release the locking engagement of the locking member 22 and the force-exerting member 21.

Exemplarily, one end of the third clastic member 32 is in contact with the collision member 31, and the other end of the third elastic member 32 is in contact with the body 10. When the collision member 31 moves in the first direction, the third elastic member 32 elastically compresses and stores energy squeezed by the collision member 31 and the body 10, and a direction of the elastic compression of the third elastic member 32 is the first direction. Moreover, when the external force exerted on the collision portion 312 in the first direction is released, the third elastic member 32 extends and exerts an elastic force on the collision member 31, causing the collision member 31 to move relative to the body 10 toward a side away from the locking member 22 by an elastic force of the third elastic member 32, with a direction of elastic compression of the third clastic member 32 being opposite to the first direction.

For example, the third elastic member 32 is a spring that may be elastically deformable in the first direction.

Thus the collision mechanism 30 may trigger the ejection mechanism 20 to eject the target object 60 from the placement position 143 when subjected to an external force collision, and reset after the external force is removed, so that the collision mechanism 30 can be collided more than one time to trigger the ejection mechanism 20, further achieving the effect of repeated play and enhancing the play experience of the toy car 1.

As shown in FIG. 11, in some embodiments, the collision mechanism 30 includes at least two.

It should be understood that at least a part of the collision portion 312 of each collision mechanism 30 is exposed outside the body 10, so that when an exposed side of the collision portion 312 is subjected to a collision from outside of the toy car 1, the collision portion 312 exposed to the body 10 is subjected to an external force, causing the collision member 31 to move relative to the body 10 toward the locking member 22, and exerting a force on the locking member 22 through the transmission portion 311 to release the locking engagement of the locking member 22 and the force-exerting member 21.

As shown in FIG. 11, exemplarily, the collision mechanism 30 includes two, and the two collision mechanisms 30 are arranged on opposite sides of the ejection mechanism 20. At least a part of the collision portion 312 of one collision mechanism 30 is exposed outside a first side of the body 10, and at least a part of the collision portion 312 of the other collision mechanism 30 is exposed outside a second side of the body 10, the first side is opposite to the second side.

Thus, the collision mechanism 30 can trigger the ejection mechanism 20 to eject the target object 60 out of the placement position 143 when subjected to collision with external forces in multiple directions, increasing play interest.

Figure 7:
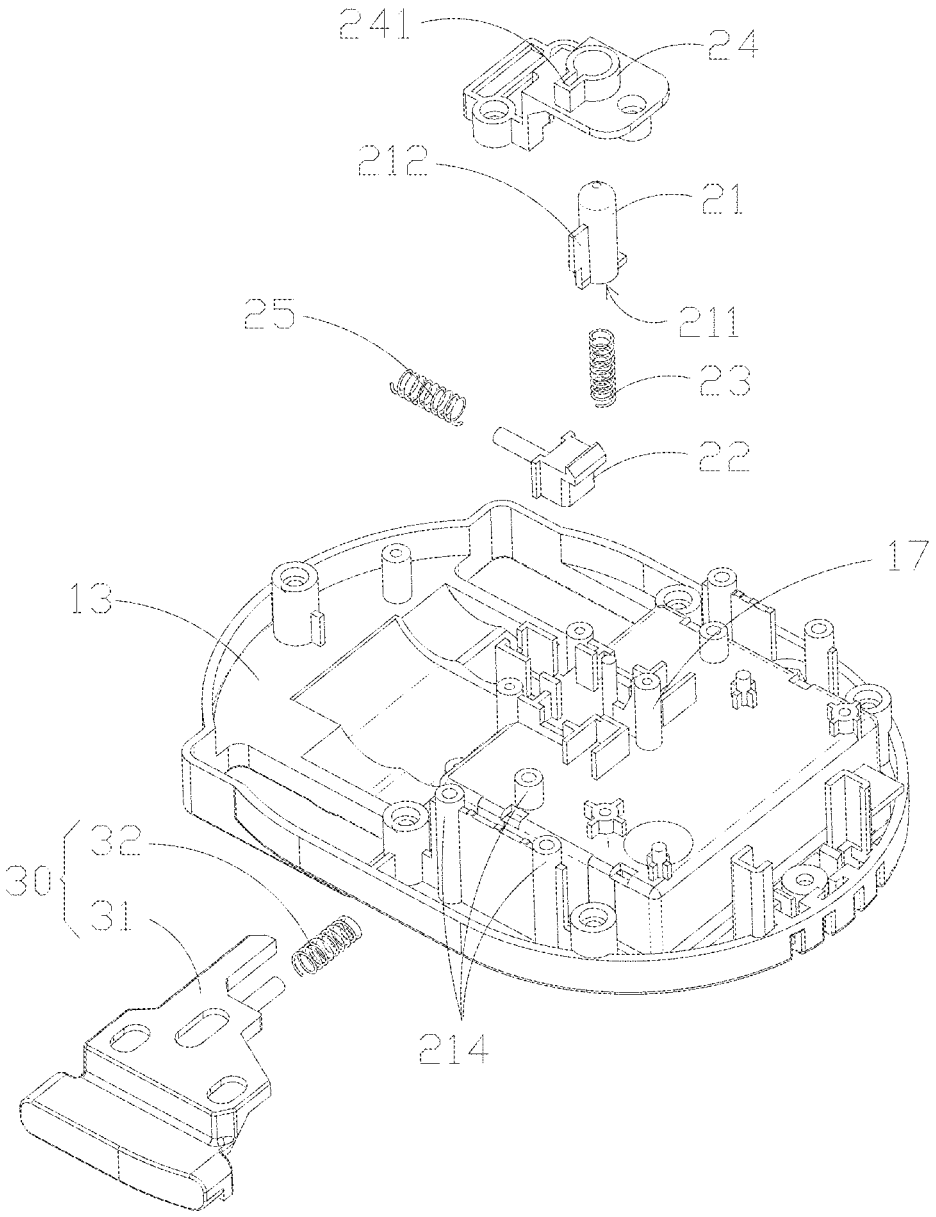
FIG. 7 is an exploded view of an ejection mechanism of a toy car according to one embodiment of the present disclosure.

As shown in FIG. 7 and FIG. 11, in some embodiments, the body 10 further includes at least one limiting post 214, and the collision member 31 further includes at least one guiding groove 313, the guiding groove 313 is adapted to the limiting post 214 and extends in the first direction.

When the collision member 31 moves relative to the body 10 toward the locking member 22 or moves relative to the body 10 toward a side away from the locking member 22 to reset, the limiting post 214 moves in the guiding groove 313 along a direction of extension of the guiding groove 313.

Specifically, the limiting post 214 and the guiding groove 313 are configured to cooperate in limiting movement of the collision member 31 when the collision member 31 moves relative to the body 10. The guiding groove 313 extends in the first direction, so that when the collision member 31 is subjected to an external force in the first direction, the collision member 31 moves along the first direction, the limiting post 214 moves in the guiding groove 313 along a direction opposite to the first direction.

As shown in FIG. 7 with FIG. 11, in some embodiments, the limiting post 214 includes at least three, and the three limiting posts 214 are arranged in a triangular configuration.

Specifically, the body 10 is configured with three limiting posts 214 arranged in a triangular configuration on a side closer to the collision member 31. Corresponding to the limiting posts 214, the collision member 31 is configured with guiding grooves 313 adapted to the three limiting post 214, and each guiding groove 313 extends in a first direction. When the collision member 31 moves toward the locking member 22 relative to the body 10, or moves toward a side away from the locking member 22 to reset, each limiting post 214 moves in the corresponding guiding groove 31.

It should be noted that the three limit columns 214, arranged in a triangular configuration, can effectively prevent the collision member 31 from deflecting when the collision member 31 is collided by an external force, and be compatible with an external force which is angled relative to the first direction, improving the stability of the collision mechanism 30 triggering the ejection mechanism 20.

In some embodiments, a side of the transmission portion 311 closer to the locking member 22 is configured with a third wedge-shaped surface 314, and a side of the locking member 22 closer to the transmission portion 311 is configured with a fourth wedge-shaped surface 222, the fourth wedge-shaped surface 222 is adapted to the third wedge-shaped surface 314.

Specifically, when an exposed part of the collision portion 312 is exerted with a force in the first direction and moves toward the locking member 22, the transmission portion 311 exerts a force on the fourth wedge-shaped surface 222 of the locking member 22 through the third wedge-shaped surface 314, the third wedge-shaped surface 314 and the fourth wedge-shaped surface 222 are in transmission cooperation to make the locking member 22 move away from the force-exerting member 21, so that the locking engagement of the locking member 22 and the force-exerting member 21 is released.

Figure 12:
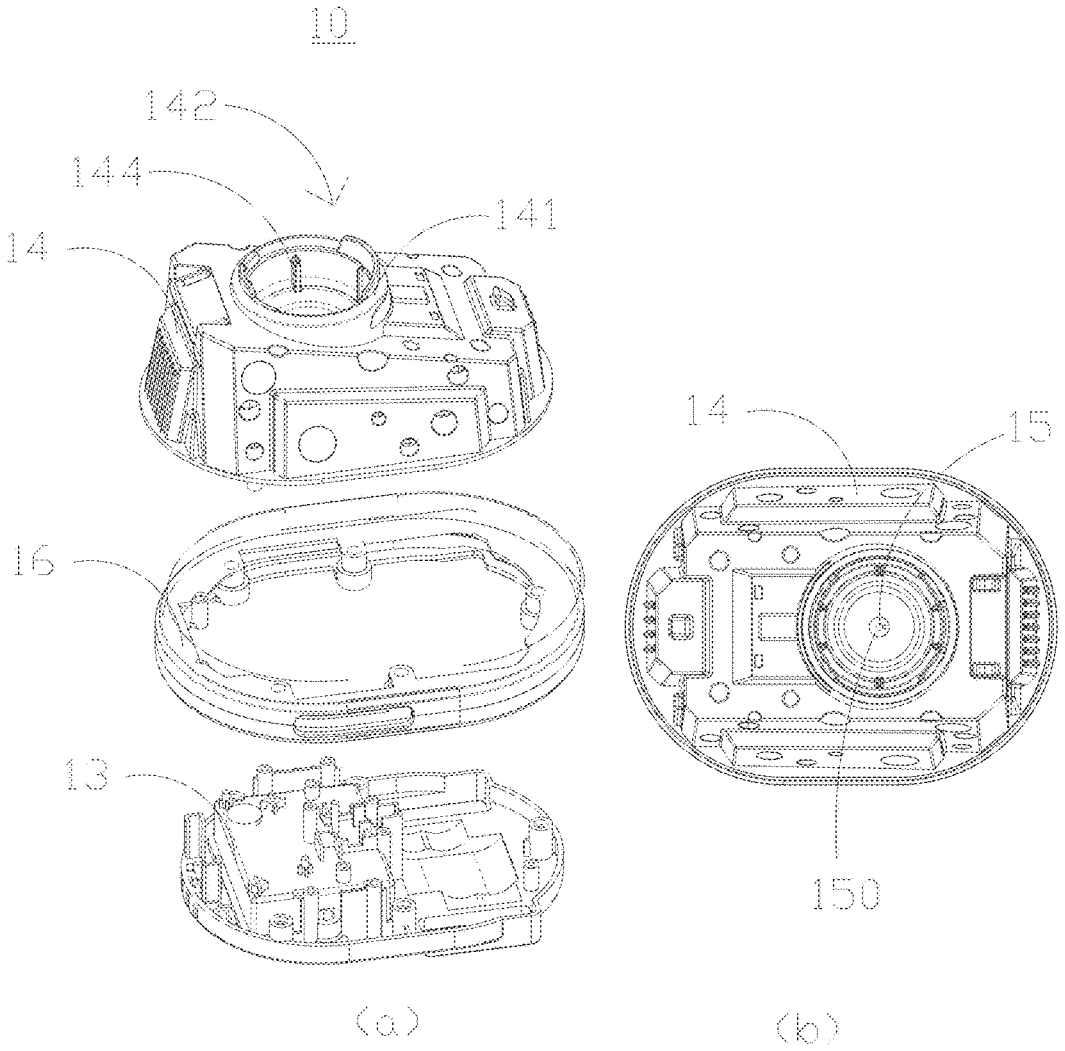
FIG. 12 is a structural exploded view of a body according to one embodiment of the present disclosure.
Figure 13:
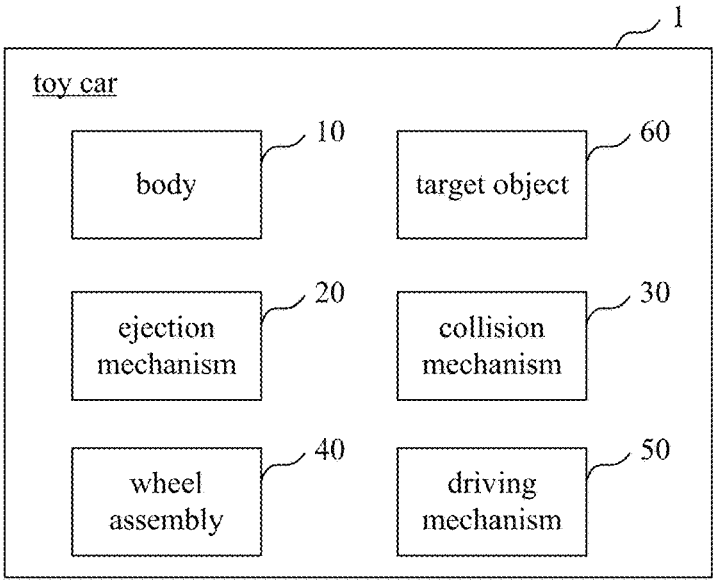
FIG. 13 is a modular structure diagram of a toy car according to another embodiment of the present disclosure.
Figure 14:
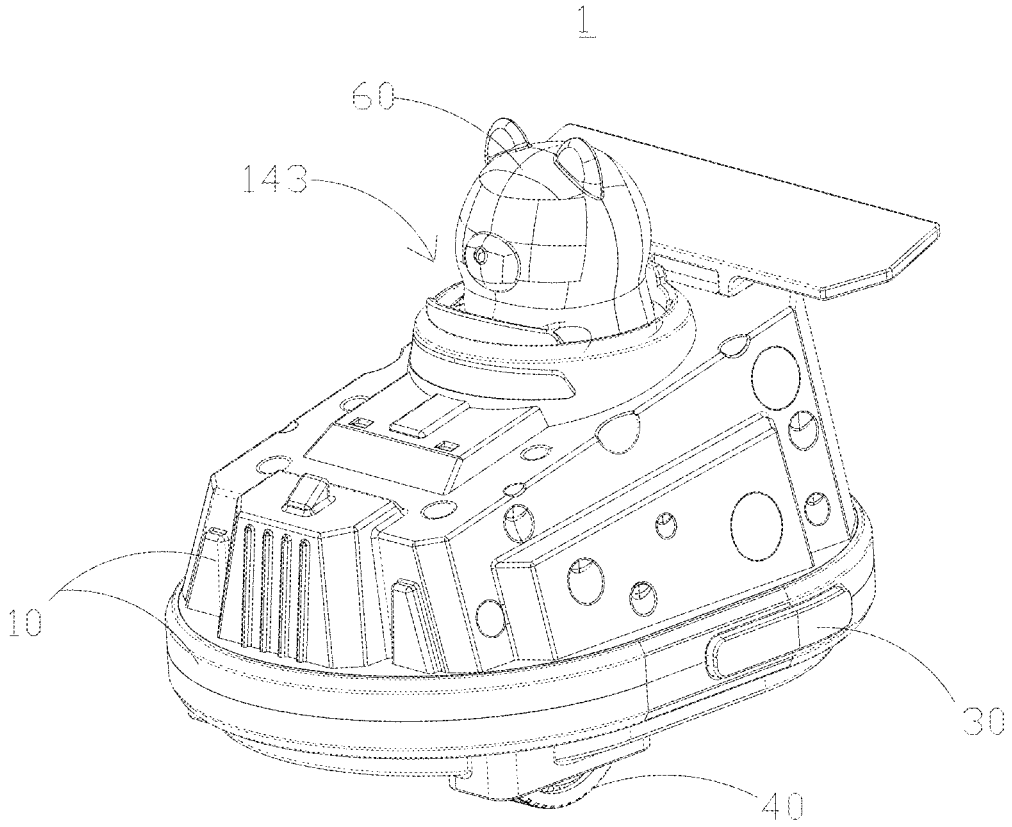
FIG. 14 is a schematic structural diagram of a toy car according to yet another embodiment of the present disclosure.

As shown in FIG. 12, in some embodiments, the body 10 includes at least a chassis 13 and a housing 14 detachably connected to the chassis 13, the chassis 13 and the housing 14 cooperate to form a receiving cavity 150, and the receiving cavity includes an opening 15 opposite to the placement position 143.

Wherein, the ejection mechanism 20 is accommodated within the receiving cavity 150 and can exert a force on the target object 60 placed at the placement position 143 through the opening 15.

Specifically, the opening 15 is configured corresponding to the placement position 143. During the ejection mechanism 20 switches from the locked state to the unlocked state, the ejection mechanism 20 moves from the receiving cavity 150 toward the opening 15 and exerts a force on the target object 60 placed at the placement position 143 through the opening 15 to eject the target object 60.

Furthermore, the force-exerting member 21 may be pressed in a direction toward the body 10 through the opening 15 to move the force-exerting member 21 to the predetermined position, or the target object 60 may be pressed to the placement position 143 so that the target object 60 exerts a force on the force-exerting member 21 in a direction toward the body 10 through the opening 15 to move the force-exerting member 21 to the predetermined position, so that the force-exerting member 21 is engaged in a locking engagement with the locking member 22, switching the ejection mechanism 20 from the unlocked state to the locked state.

Exemplarily, the first guide post 17 and/or the limiting post 214 are/is arranged on the chassis 13.

In some embodiments, the body 10 further includes a protective frame 16 arranged around the chassis 13, and at least a part of the collision mechanism 30 is exposed outside the protective frame 16.

Wherein, a thickness of the protective frame 16 in a height direction of the body 10 is H, the part of the collision mechanism 30 exposed outside the protective frame 16 in the height direction of the body 10 is at least ⅔H.

Specifically, the protective frame 16 arranged around the chassis 13 is configured for collision protection of components such as the chassis 13, the housing 14, and the ejection mechanism 20 and the driving mechanism 50 accommodated within the receiving cavity 150.

Moreover, compared to related products, the toy car 1 provided by the embodiments of the present disclosure increases the part of the collision mechanism 30 exposed outside the protective frame 16, making the collision mechanism 30 easier to be triggered by an external force, further enabling the ejection mechanism 20 to eject the target object 60 from the placement position 143, and enhancing play experience of the toy car 1.

As shown in FIG. 1 to FIG. 12, in some embodiments, the housing 14 further includes an object mounting portion 141 with an object mounting groove 142, the object mounting groove 142 includes at least one placement position 143, and the object mounting groove 142 is in communication with the holding cavity through the opening 15.

Exemplarily, the object mounting portion 141 is bowl-shaped and includes the object mounting groove 142, and the placement position 143 is formed inside the object mounting groove 142, the number of placement positions 143 may be one, two, or more.

Exemplarily, the object mounting portion 141 is arranged at a top of the housing 14, the object mounting groove 142 is in communication with receiving cavity 150 through the opening 15, and a bottom of the object mounting portion 141 is opposite to the force-exerting member 21 of the ejection mechanism 20. During the ejection mechanism 20 switches from the locked state to the unlocked state, and the ejection mechanism 20 may move in a direction of the object mounting groove 142 to exert a force on a bottom of the target object 60 placed at the placement position 143 through the opening 15, so as to eject the target object 60 from the placement position 143.

As shown in FIG. 12, in some embodiments, the object mounting portion 141 includes a mounting-guiding structure 144 on a circumference of the object mounting groove 142, the mounting-guiding structure 144 is adapted to the target object 60.

It should be noted that the object mounting portion 141 is formed on the circumference of the object mounting groove 142, and plays a guiding role in the process of mounting the target object 60 to the placement position 143 of the object mounting groove 142, being convenient for placing the target object 60 into the placement position 143 of the object mounting groove 142, reducing play threshold and enhancing play interest of the toy car 1.

Exemplarily, the object mounting portion 141 is bowl-shaped and includes the object mounting groove 142, the mounting-guiding structure 144 includes a guiding groove or a guiding rib arranged on an inner wall of the object mounting groove 142 and adapted to an outer wall of the target object 60, wherein the number of mounting-guiding structure 144 may be one, two, or more.

For example, when a convex rib is arranged on the outer wall of the target object 60, the mounting-guiding structure 144 includes a guiding groove arranged on the inner wall of the object mounting groove 142 and adapted to the convex rib. Conversely, when a groove is arranged on the outer wall of the target object 60, the mounting-guiding structure 144 includes a guiding rib arranged on the inner wall of the object mounting groove 142 and adapted to the groove.

In some embodiments, the mounting-guiding structures 144 include at least two, and the at least two mounting-guiding structures 144 are evenly arranged around object mounting groove 142, so that the target object 60 can be conveniently installed to the placement position 143 in multiple directions of the object installation slot 142, and the target object 60 can be guided during the installation process, reducing play threshold and enhancing play interest of the toy car 1.

As shown in FIG. 1 to FIG. 14, embodiments of the present disclosure also provide another toy car 1 configured to perform a traveling action for play.

Specifically, the toy car 1 provided by an embodiment of the present disclosure includes a body 10, an ejection mechanism 20, a collision mechanism 30, a wheel assembly 40, a driving mechanism 50, and a target object 60, wherein the body 10 includes a placement position 143, and the target object 60 is placed at the placement position 143.

The specific structure of the body 10, the ejection mechanism 20, the collision mechanism 30, the wheel assembly 40, and the driving mechanism 50 of the toy car 1, and the cooperation with each other can be described with reference to the specific description in the above embodiments, and will not be repeated here.

The target object 60 is, for example, a doll or other objects, the ejection mechanism 20, under a condition of switching from a locked state to an unlocked state, the ejection mechanism 20 may have relative displacement relative to the body 10, and exert a force on the target object 60 placed at the placement position 143 to eject the target object 60 from the placement position 143.

In summary, embodiments of the present disclosure provide a toy car 1, the toy car 1 includes a body 10, an ejection mechanism 20, a collision mechanism 30, and a wheel assembly 40. The body 10 includes a placement position 143 for placing a target object 60, the body 10 includes a front end 11 and a rear end 12 which are opposite to each other. The ejection mechanism 20 is arranged on the body 10 and includes a locked state and an unlocked state, under a condition of switching from the locked state to the unlocked state, the ejection mechanism 20 may have relative displacement relative to the body 10, and exert a force on the target object 60 placed at the placement position 143 to eject the target object 60 from the placement position 143. The collision mechanism 30 is movably connected to the body 10 and is configured to exert a force on the ejection mechanism 20 when triggered by an external force, causing the ejection mechanism 20 to switch from the locked state to the unlocked state. The wheel assembly 40 includes at least a first wheel assembly 41. The first wheel assembly 41 includes a first wheel 411 and a second wheel 412, and the first wheel 411 and the second wheel 412 are respectively arranged on opposite sides of the body 10. The driving mechanism 50 includes a first driving motor 51, a second driving motor 52, a first transmission structure 53, and a second transmission structure 54. Wherein, the first driving motor 51 is configured to connect with the first wheel 411 and drive the first wheel 411 through the first transmission structure 53, the second driving motor 52 is configured to connect with the second wheel 412 and drive the second wheel 412 through the second transmission structure 54, and both the first driving motor 51 and the second driving motor 52 can be driven independently, to reduce a turning radius of the toy car 1, resulting in enhancing driving flexibility of the toy car 1, especially steering flexibility, and further enhancing interest of users playing with the toy car 1.

Those having ordinary skill in the art can understand that all or some of functional modules/units in steps, systems, and apparatuses of the methods disclosed above can be implemented as software, firmware, hardware, and their appropriate combinations. In hardware embodiments, a division between functional modules/units referred to in the above description does not necessarily correspond to a division of physical components. For example, a physical component may have multiple functions; or, a function or a step may be performed by several physical components in cooperation. Some or all of the physical components may be implemented as software executed by a processor, such as a central processor, a digital signal processor, or a microprocessor; or as hardware; or as a circuit, such as a dedicated circuit. Such software may be distributed on a computer-readable medium, which may include a computer storage medium (or non-transitory medium) and a communication medium (or transitory medium).

It should be understood that terms used in the specification of the present disclosure are only to describe specific embodiments and are not intended to limit the present disclosure. Unless otherwise clearly specified and limited, terms "mount", "connect", "connected" should be understood in a broad sense, for example, they may be a fixed connection, a detachable connection, or an integral connection; they may be a mechanical connection or an electrical connection; they can be directly connected or indirectly connected through an intermediary, and can be an internal communication between two components. Those having ordinary skill in the art can understand specific meaning of the above terms in the present disclosure according to the specific situation. As used in the specification and the accompanying claims of the present disclosure, unless the context clearly indicates otherwise, singular forms "a", "an" and "the" are intended to include plural forms.

It should also be understood that term "and/or" used in the specification and the accompanying claims of the present disclosure refers to any combination of one or more of the associated listed items and all possible combinations, and includes these combinations. It should be noted that in the present disclosure, terms "including," "comprising," or any other variant are intended to cover non-exclusive inclusion, so that a process, method, article, or system including a series of elements not only includes those elements but also includes other elements that are not explicitly listed, or includes elements inherent to such a process, method, article, or system.

What is claimed is:

1. A toy car, comprising:

a body, the body includes a placement position for placing a target object, the body includes a front end and a rear end which are opposite to each other;

an ejection mechanism, the ejection mechanism is arranged on the body and includes a locked state and an unlocked state; under a condition of switching from the locked state to the unlocked state, the ejection mechanism has relative displacement relative to the body, and exerts a force on the target object placed at the placement position to eject the target object from the placement position;

a collision mechanism, the collision mechanism is movably connected to the body and is configured to exert a force on the ejection mechanism when triggered by an external force, causing the ejection mechanism to switch from the locked state to the unlocked state;

a wheel assembly, the wheel assembly includes at least a first wheel assembly, the first wheel assembly includes a first wheel and a second wheel, the first wheel and the second wheel are respectively arranged on opposite sides of the body; and a driving mechanism, the driving mechanism includes a first driving motor, a second driving motor, a first transmission structure, and a second transmission structure;

wherein, the first driving motor is configured to connect with the first wheel and drive the first wheel through the first transmission structure, the second driving motor is configured to connect with the second wheel and drive the second wheel through the second transmission structure;

wherein the driving mechanism further includes a driving mounting member with a mounting chamber, the first driving motor, the second driving motor, the first transmission structure, and the second transmission structure are all accommodated in the mounting chamber, and at least two connecting portions are arranged on a peripheral side of the driving mounting member, the driving mounting member is detachably connected to the body through the connecting portion.

2. The toy car according to claim 1, wherein the ejection mechanism includes a force-exerting member, a locking member engaged in a locking engagement with the force-exerting member, and a first elastic member for providing an elastic force to the force-exerting member; the force-exerting member is displaced relative to the body during elastic deformation process of the first elastic member;

wherein, When the ejection mechanism is in the locked state, the locking member is engaged in a locking engagement with the force-exerting member, and the first elastic member is deformed to store energy through the force-exerting member;

when the locking engagement of the locking member and the force-exerting member is released, the force-exerting member moves toward a side closer to the placement position relative to the body by an elastic force of the first elastic member, exerting a force on the target object placed at the placement position.

3. The toy car according to claim 2, wherein the force-exerting member is configured with a first chamber for accommodating the first elastic member, the body is configured with a first guide post, and the first elastic member is mounted around the first guide post and is in contact between the force-exerting member and the body;

the ejection mechanism further includes a limiting member, the limiting member is connected to the body and is configured to limit a moving distance of the force-exerting member relative to the body in an ejection direction.

4. The toy car according to claim 3, wherein the limiting member is detachably connected to the body, an inner side of the limiting member is provided with a first guiding portion, and a peripheral side of the force-exerting member is further provided with a second guiding portion adapted to the first guiding portion;

wherein, the second guiding portion includes one;

or, the second guiding portion includes at least two, and the at least two second guiding portions are spaced apart on a peripheral side of the force-exerting member.

5. The toy car according to claim 2, wherein under force-exerting trigger of the collision mechanism, the locking member is displaced relative to the body; the ejection mechanism further includes a second elastic member arranged between the locking member and the body, the second elastic member is configured to provide an elastic force to the locking member;

wherein, when the locking member is triggered by the collision mechanism, the locking member moves toward a side away from the force-exerting member to release the locking engagement of the locking member and the force-exerting member, and cause the second elastic member to deform and store energy;

when the collision mechanism releases the force exerted on the locking member, the second elastic member releases elastic energy storage and drives the locking member to move toward a side closer to the force-exerting member.

6. The toy car according to claim 5, wherein the force-exerting member moves toward a side closer to the body by an external force, and exerts a force on the locking member to move the locking member away from the force-exerting member; during the process of the locking member moving away from the force-exerting member, the locking member compresses the second elastic member, causing the second elastic member to deform and store energy;

when the force-exerting member moves toward a side closer to the body to a predetermined position, the second elastic member releases the elastic energy storage and drives the locking member to move toward a side closer to the force-exerting member, and be engaged in a locking engagement with the force-exerting member, causing the ejection mechanism to be in a locked state.

7. The toy car according to claim 6, wherein the force-exerting member is configured with a snap-fit portion, the locking member is snap-fitted with the force-exerting member through the snap-fit portion, so that the force-exerting member is engaged in a locking engagement with the locking member;

wherein, the snap-in portion includes a first wedge-shaped surface on a side closer to the body, the locking member includes a second wedge-shaped surface on a side away from the body, the second wedge-shaped surface is adapted to the first wedge-shaped surface.

8. The toy car according to claim 2, wherein the collision mechanism includes a collision member and a third elastic member for providing an elastic force to the collision member;

during elastic deformation process of the third elastic member, the collision member is displaced relative to the body;

wherein, the collision member includes a transmission portion arranged on a side closer to the locking member and a collision portion arranged on a side away from the locking member, and at least a part of the collision portion is exposed outside the body;

when the collision portion is subjected to an external force in a first direction, the collision member moves toward the locking member relative to the body, and exerts a force on the locking member through the transmission portion to release the locking engagement of the locking member and the force-exerting member; during a movement process of the collision member in the first direction, the third elastic member deforms and stores energy, the first direction is a direction of the transmission portion relative to the collision portion;

when the external force on the collision portion in the first direction is released, the collision member moves relative to the body toward a side away from the locking member by an elastic force of the third elastic member to reset.

9. The toy car according to claim 8, wherein the body further includes at least one limiting post, and the collision member further includes at least one guiding groove, the guiding groove is adapted to the limiting post and extends in the first direction;

when the collision member moves relative to the body toward the locking member or moves relative to the body toward a side away from the locking member to reset, the limiting post moves in the guiding groove along a direction of extension of the guiding groove.

10. The toy car according to claim 9, wherein the limiting post includes at least three, and the three limiting posts are arranged in a triangular configuration.

11. The toy car according to claim 8, wherein a side of the transmission portion closer to the locking member is configured with a third wedge-shaped surface, and a side of the locking member closer to the transmission portion is configured with a fourth wedge-shaped surface, the fourth wedge-shaped surface is adapted to the third wedge-shaped surface.

12. The toy car according to claim 1, wherein the body includes a chassis and a housing detachably connected to the chassis, the chassis and the housing cooperate to form a receiving cavity, and the receiving cavity includes an opening opposite to the placement position, the ejection mechanism is accommodated within the receiving cavity and is configured to exert a force on the target object placed at the placement position through the opening;

the body further includes a protective frame arranged around the chassis, and at least a part of the collision mechanism is exposed outside the protective frame;

wherein, a thickness of the protective frame in a height direction of the body is H, and the part of the collision mechanism exposed outside the protective frame in the height direction of the body is at least ⅔H.

13. The toy car according to claim 12, wherein the housing further includes an object mounting portion with an object mounting groove, the object mounting groove includes at least one placement position, and the object mounting groove is in communication with the holding cavity through the opening;

the object mounting portion includes a mounting-guiding structure on a circumference of the object mounting groove, the mounting-guiding structure is adapted to the target object.

14. The toy car according to claim 1, wherein the first wheel and the second wheel are respectively arranged on opposite sides of the front end of the body; or, the first wheel and the second wheel are respectively arranged on opposite sides of the rear end of the body.

15. The toy car according to claim 1, wherein the wheel assembly further includes a second wheel assembly, the second wheel assembly includes a third wheel and a fourth wheel, the first wheel is arranged on a first side of the front end of the body, the third wheel is arranged on a second side of the front end of the body, the fourth wheel is arranged on a first side of the rear end of the body, the second wheel is arranged on a second side of the rear end of the body.

16. The toy car according to claim 1, wherein the wheel assembly further includes a second wheel assembly, the first wheel assembly and the second wheel assembly both are arranged on the body, and the first wheel assembly cooperates with the second wheel assembly to maintain balance of the body.

17. The toy car according to claim 1, wherein the first transmission structure includes at least one of a gear assembly, a belt and a chain; or;

the second transmission structure includes at least one of a gear assembly, a belt and a chain.

18. The toy car according to claim 1, wherein the first transmission structure includes a first gear assembly, and the first gear assembly is connected between an output end of the first driving motor and the first wheel, the first driving motor is configured to drive the first wheel to rotate through the first gear assembly; or;

the second transmission structure includes a second gear assembly, and the second gear assembly is connected between an output end of the second driving motor and the second wheel, and the second driving motor is configured to drive the second wheel to rotate through the second gear assembly.

19. A toy car, comprising:

a body, the body includes a placement position;

a target object, the target object is placed at the placement position;

an ejection mechanism, the ejection mechanism is arranged on the body and includes a locked state and an unlocked state; under a condition of switching from the locked state to the unlocked state, the ejection mechanism has relative displacement relative to the body, and exerts a force on a target object placed at the placement position to eject the target object from the placement position;

a collision mechanism, the collision mechanism is movably connected to the body and is configured to exert a force on the ejection mechanism when triggered by an external force, causing the ejection mechanism to switch from the locked state to the unlocked state;

a wheel assembly, the wheel assembly includes at least a first wheel assembly, the first wheel assembly includes a first wheel and a second wheel; the first wheel and the second wheel are respectively arranged on opposite sides of the front end of the body; or, the first wheel and the second wheel are respectively arranged on opposite sides of the rear end of the body; and a driving mechanism, the driving mechanism includes a first driving motor, a second driving motor, a first transmission structure, and a second transmission structure;

wherein, the first driving motor is configured to connect with the first wheel and drive the first wheel through the first transmission structure, the second driving motor is configured to connect with the second wheel and drive the second wheel through the second transmission structure, and both the first driving motor and the second driving motor are driven independently;

wherein the driving mechanism further includes a driving mounting member with a mounting chamber, the first driving motor, the second driving motor, the first transmission structure, and the second transmission structure are all accommodated in the mounting chamber, and at least two connecting portions are arranged on a peripheral side of the driving mounting member, the driving mounting member is detachably connected to the body through the connecting portion.

* * * * *